US007114202B1

(12) United States Patent
Padrick

(10) Patent No.: US 7,114,202 B1
(45) Date of Patent: Oct. 3, 2006

(54) PORTABLE MULTI-POINT FLUID DELIVERY SYSTEM

(76) Inventor: Thomas Arnold Padrick, 6602 Emil Ave., Cocoa, FL (US) 32927

( * ) Notice: Subject to any disclaimer, the term of this patent is extended or adjusted under 35 U.S.C. 154(b) by 0 days.

(21) Appl. No.: 11/135,748

(22) Filed: May 24, 2005

Related U.S. Application Data

(63) Continuation-in-part of application No. 10/705,136, filed on Nov. 10, 2003, now abandoned.

(60) Provisional application No. 60/430,196, filed on Dec. 2, 2002.

(51) Int. Cl.
*A47K 3/22* (2006.01)

(52) U.S. Cl. ..... 4/615

(58) Field of Classification Search ..... 4/596, 4/599, 601, 603, 615–617, 567, 568, 570, 4/612

See application file for complete search history.

(56) References Cited

U.S. PATENT DOCUMENTS

| | | | | |
|---|---|---|---|---|
| 1,102,736 | A * | 7/1914 | Grabau | 4/567 |
| 1,156,474 | A | 10/1915 | Gifford | |
| 1,807,900 | A * | 6/1931 | Dougherty | 4/653 |
| 2,631,062 | A | 3/1953 | Tiedemann et al. | |
| 3,982,284 | A | 9/1976 | Becker | |
| D256,610 | S | 8/1980 | Belkir | |
| 4,720,878 | A | 1/1988 | Viner | |
| 4,807,310 | A | 2/1989 | Sedala | |
| 4,934,001 | A | 6/1990 | Landreth | |
| D316,737 | S | 5/1991 | Warren et al. | |
| 5,070,552 | A * | 12/1991 | Gentry et al. | 4/615 |
| 5,224,652 | A | 7/1993 | Kessler | |
| D339,860 | S | 9/1993 | Hildebrand | |
| 5,331,778 | A | 7/1994 | Mazpule et al. | |
| 5,365,620 | A | 11/1994 | MacLeod | |
| 5,446,930 | A | 9/1995 | Clark | |
| 5,507,275 | A | 4/1996 | Clark | |
| 5,564,138 | A | 10/1996 | Simpson | |
| 5,983,419 | A | 11/1999 | Carroll | |
| 5,996,142 | A * | 12/1999 | Colman | 4/615 |
| 6,202,594 | B1 * | 3/2001 | Kirschner | 119/72 |
| D457,605 | S | 5/2002 | Balish, Jr. | |

* cited by examiner

*Primary Examiner*—Huyen Le
(74) *Attorney, Agent, or Firm*—Malloy & Malloy, P.A.

(57) ABSTRACT

A portable multi-point fluid delivery system includes a conduit assembly having a stationary conduit and a positionable conduit disposed in fluid communication with one another. A fluid control assembly is provided which includes at least a fixed fluid delivery member and a positionable fluid delivery member, the fluid control assembly being structured to regulate fluid flow from the fixed fluid delivery member and the positionable fluid delivery member, either independently or simultaneously. The fluid conduit assembly also includes a flexible conduit extension structured to permit the positionable fluid delivery member to be disposed in a spaced apart relation from the stationary fluid delivery member, thereby permitting fluid to be delivered to any of a plurality of spaced apart locations utilizing a single system.

5 Claims, 5 Drawing Sheets

FIG. 1

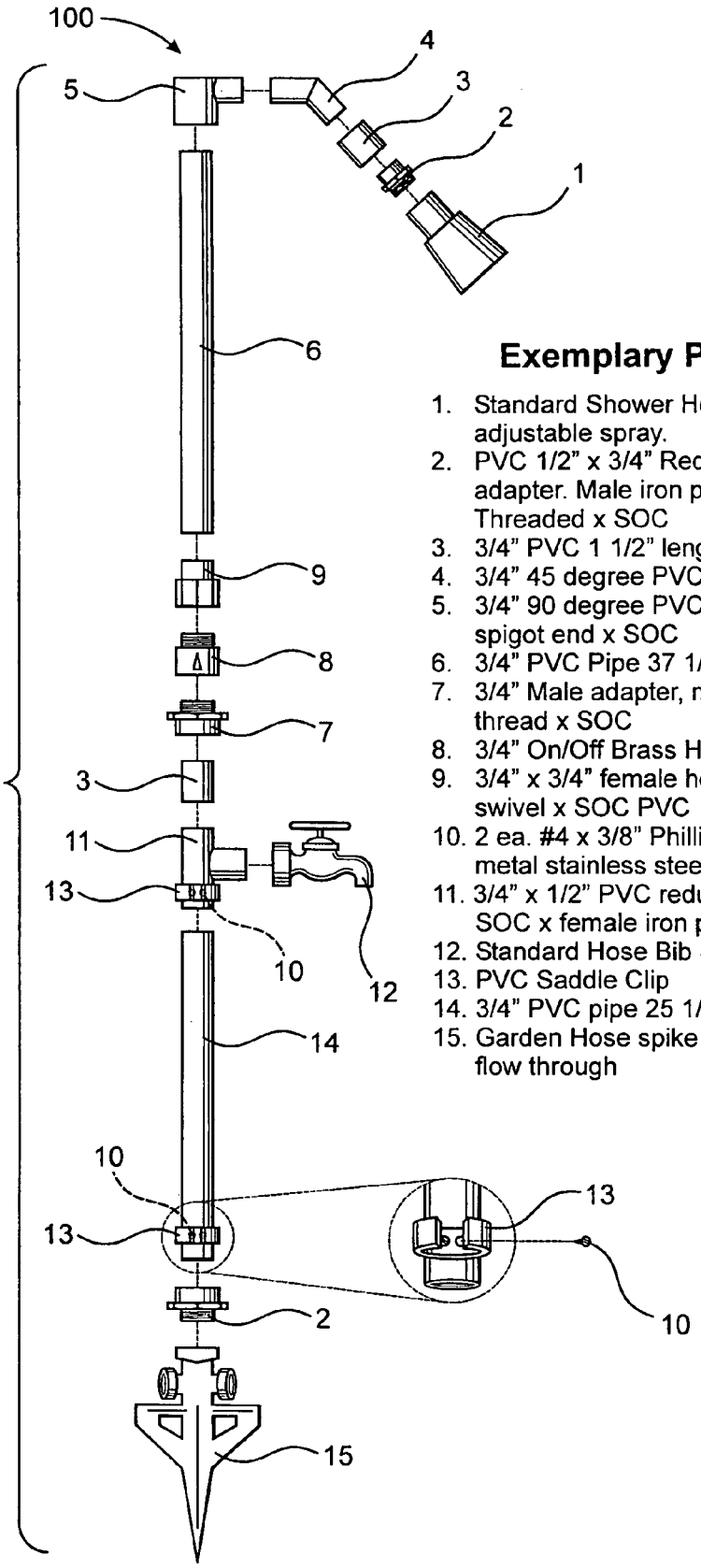

Exemplary Parts List

1. Standard Shower Head, adjustable spray.
2. PVC 1/2" x 3/4" Reducing male adapter. Male iron pipe. Threaded x SOC
3. 3/4" PVC 1 1/2" length
4. 3/4" 45 degree PVC ELL SOC
5. 3/4" 90 degree PVC street ELL spigot end x SOC
6. 3/4" PVC Pipe 37 1/2" length
7. 3/4" Male adapter, male iron pipe thread x SOC
8. 3/4" On/Off Brass Hose Valve
9. 3/4" x 3/4" female hose threaded swivel x SOC PVC
10. 2 ea. #4 x 3/8" Phillips oval sheet metal stainless steel screws
11. 3/4" x 1/2" PVC reducing tee-SOC x female iron pipe thread
12. Standard Hose Bib Spigot 1/2" brass
13. PVC Saddle Clip
14. 3/4" PVC pipe 25 1/2" length
15. Garden Hose spike base solid metal flow through

PORTABLE MULTI-POINT FLUID DELIVERY SYSTEM

CLAIM OF PRIORITY

The present application is a Continuation-In-Part of previously filed and currently pending U.S. patent application Ser. No. 10/705,136 which was filed on Nov. 10, 2003 now abandoned, and which claims the benefit of U.S. Provisional Patent Application filed in the U.S. Patent and Trademark Office on Dec. 2, 2002 and assigned Ser. No. 60/430,196, now abandoned, both of which are incorporated herein by reference.

BACKGROUND OF THE INVENTION

1. Field of the Invention

The present invention is directed to a portable multi-point fluid delivery system structured to permit operation of a fixed fluid delivery member while simultaneously operating a positionable fluid delivery member, wherein the positionable fluid delivery member is operable over a range of locations which are remote from the fixed delivery member. At least one embodiment of this invention relates to portable outdoor shower and faucet systems, specifically, to such units that are used for recreational, safety and practical purposes in or around homes, campers, recreational vehicles, boats, and other such structures. This invention is designed to be freestanding, using a 7-inch winged metal spike inserted in the ground as the stabilizer.

2. Description of the Related Art

For years, recreationalists have claimed the single biggest problem with staying outdoors is the lack of potable water with which to clean. Showers at campgrounds, while most are isolated and uncomfortable to its users, have served as, oftentimes, the sole source for clean water to wash themselves and their equipment.

Space is also a factor for recreationalists. With all the gear required to make an outing enjoyable, little space is left for other items, such as bulky water-supply systems.

Previously, there have been attempts to provide a means by which to shower outdoors. One such attempt is found in the "Dismantlable Evaporative Cooling Shower" of Viner U.S. Pat. No. 4,720,878. Another, for a "Portable Shower" of Belkir U.S. Pat. No. Des. 256,610. A hanging variety is shown in "Portable Shower Spray Apparatus" of Landreth U.S. Pat. No. 4,934,001. Another "Outdoor Shower Apparatus" of MacLeod U.S. Pat. No. 5,365,620 shows a unit mounted to a building having hot and cold water. Others have enclosures for the shower area, for example, "Portable Enclosure Assembly" of Mazpule U.S. Pat. No. 5,331,778 and "Portable Shower" of Simpson U.S. Pat. No. 5,564,138 assigned to The Coleman Company Inc. Further, some have reservoirs as in the "Portable Shower" of Hildebrand U.S. Pat. No. Des. 339,860 and "Solar Shower" of Clark U.S. Pat. No. 5,507,275 assigned to Solar Shower Partnership. There have even been showers of sorts for the specific use of children, as in the "Lawn Water Shower" of Kessler U.S. Pat. No. 5,224,652 assigned to Maui Toys, Inc. and in the "Children's Pool and Shower" of Warren U.S. Pat. No. Des. 316,737. The common beach or pool shower being permanently attached to a source of water would also be examples of previous outdoor showers.

While there are apparatuses of like name, no other known product is available with the durability, portability and functionality today's recreationalists require in their portable shower and spigot systems. A fixed unit does not allow the user the sort of flexibility required to fully enjoy the outdoors experience.

This invention, when in its two-piece form, can be used as two separate water-supply units, one free standing and one hand-held. No other like product shares such flexibility.

OBJECTS AND DISADVANTAGES

Accordingly, besides the objects and advantages of this portable shower and faucet system described in my above patent, several objects and advantages of the present invention are:

a) to provide a portable shower and faucet system with clean, potable water;

b) to provide a portable shower and faucet system that has adequate water pressure to fulfill the needs of its users;

c) to provide a portable shower and faucet system that requires minimal set-up time and effort, but provides the most functionality; and d) to provide a portable shower and faucet system that uses existing water supply equipment.

Further objects and advantages are to provide a portable shower and faucet system that virtually any person with minimal skills and abilities can assemble and use with minimal tools.

SUMMARY OF THE INVENTION

As indicated above, the present application is directed to a portable multi-point fluid delivery system. More in particular, the present invention provides a portable fluid delivery system which may be utilized to delivery a fluid, for example, potable water, to a plurality of locations either independently of one another or simultaneously. The multi-point fluid delivery system in accordance with the present invention includes a fluid conduit assembly having a stationary conduit and a positionable conduit which are disposed in a fluid communicating relation with one another. In addition, the system includes at least one fluid inlet member disposed in fluid communication with the fluid conduit assembly, the inlet member being structured to facilitate connection of the multi-point fluid delivery system to a fluid supply, such as via a standard hose bib connection.

Additionally, the multi-point fluid delivery system includes a flow control assembly comprising a fixed fluid delivery member and a positionable fluid delivery member, the fixed fluid delivery member and the positionable fluid delivery member being structured to deliver an amount of fluid to at least one of the plurality of locations. More in particular, the flow control assembly is structured to regulate a fluid flow from the fixed fluid delivery member and the positionable fluid delivery member which may occur independent of one another or, as noted above, simultaneous with one another thereby permitting the delivery of fluid to a plurality of locations at the same time.

In order to facilitate delivery of a fluid to a plurality of locations, the multi-point fluid delivery system of the present invention further comprises a conduit extension interconnected in the fluid communicating relation with the stationary conduit and the positionable conduit. More in particular, the conduit extension is structured to permit the positionable conduit, and the positionable fluid delivery member disposed in fluid communication therewith, to be disposed in a spaced apart relation from the stationary conduit in any of a plurality of spaced apart locations.

At least one embodiment of the present invention comprises a portable shower and faucet system that provides pressurized running water through a freestanding unit with two water outlets at differing heights which may be operated separately or simultaneously. The unit is designed to be completely portable and able to function in any condition as long as a pressurized water source is already present. The unit, when in its two-piece form interconnected via a flexible conduit member, permits separate or simultaneous operation of a single fixed faucet and/or a positionable hand-held wand unit, providing pressurized water for virtually any portable use at various locations.

These and other objects, features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which:

FIG. 1 shows the unassembled view of the entire unit illustrating individual parts and an exemplary parts list.

Like reference numerals refer to like parts throughout the several views of the drawings.

DETAILED DESCRIPTION OF THE PREFERRED EMBODIMENT

Figure 2:
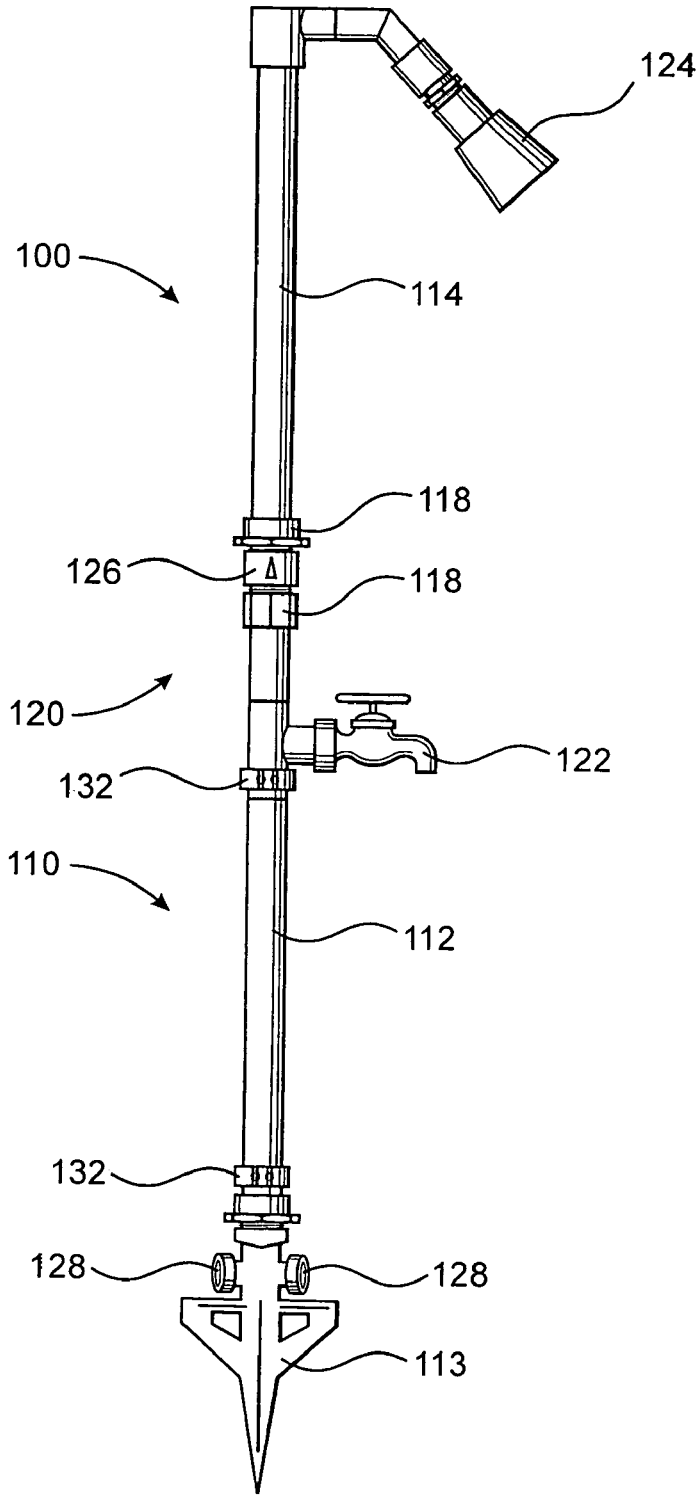
FIG. 2 shows a left lateral view of the entire unit, noting the ability to disconnect lower assembly from unit whole.
Figure 3:
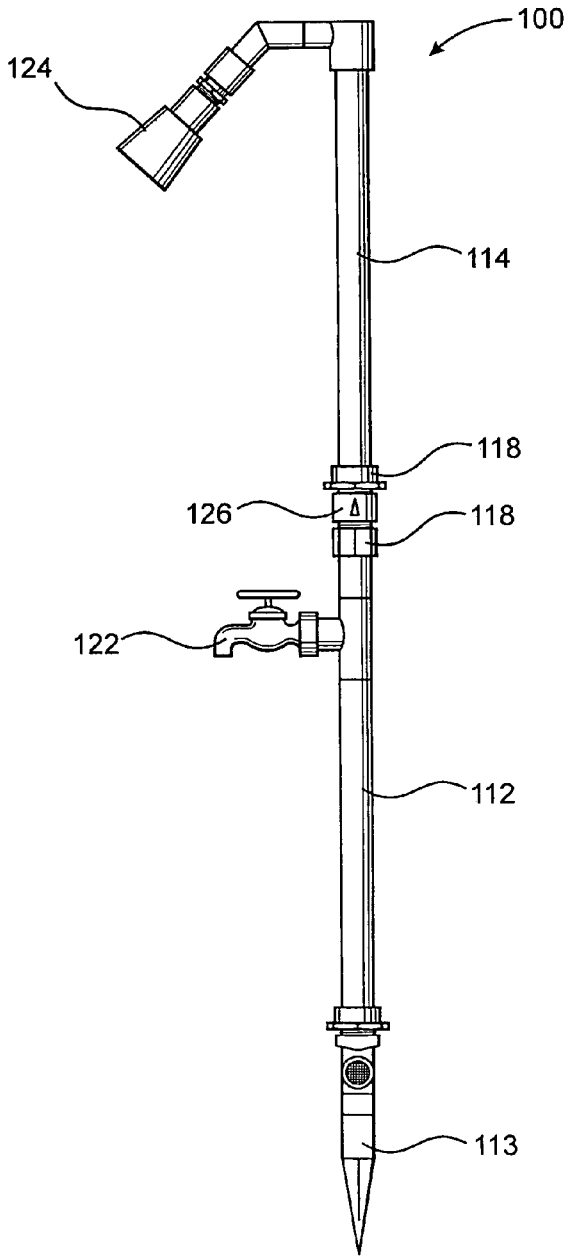
FIG. 3 shows a right lateral view of the entire unit.

The present invention is directed to a portable multi-point fluid delivery system, as shown at 100 in the figures. As previously indicated, in at least one embodiment, the present invention is structured to permit fluid delivery to a plurality of locations either independently or simultaneously. As such, the portable multi-point fluid delivery system 100 comprises a fluid conduit assembly 110. The fluid conduit assembly 110 may comprise one or more fluid conduits such as are readily available in a variety of sizes, for example, varied diameter piping, and may be constructed from any of a variety of materials commonly used for such applications including, by way of example, copper, polyvinyl chloride ("PVC"), and/or other metal or plastic materials. As will be better understood from the following disclosure, at least one portion of the fluid conduit assembly 110 of the present invention comprises a material of construction having a substantially rigid configuration.

In one embodiment, the fluid conduit assembly 100 comprises a stationary conduit 112 and a positionable conduit 114. More in particular, the stationary conduit 112 and the positionable conduit 114 are disposed in a fluid communicating relation with one another. As used herein, a fluid communicating relation shall be at least partially defined by components of the portable multi-component fluid delivery system 100 interconnected to one another in such a manner that fluid may flow between the components with negligible fluid loss therebetween. In order to facilitate establishment of the fluid communicating relation, one or more releasable connector 118 may be employed. In at least one embodiment, the releasable connector 118 comprises a standard threaded male and female hose bib connector, thereby allowing a user to quickly and easily assemble and disassemble the portable multi-point fluid delivery system 100 of the present invention.

Figure 6:
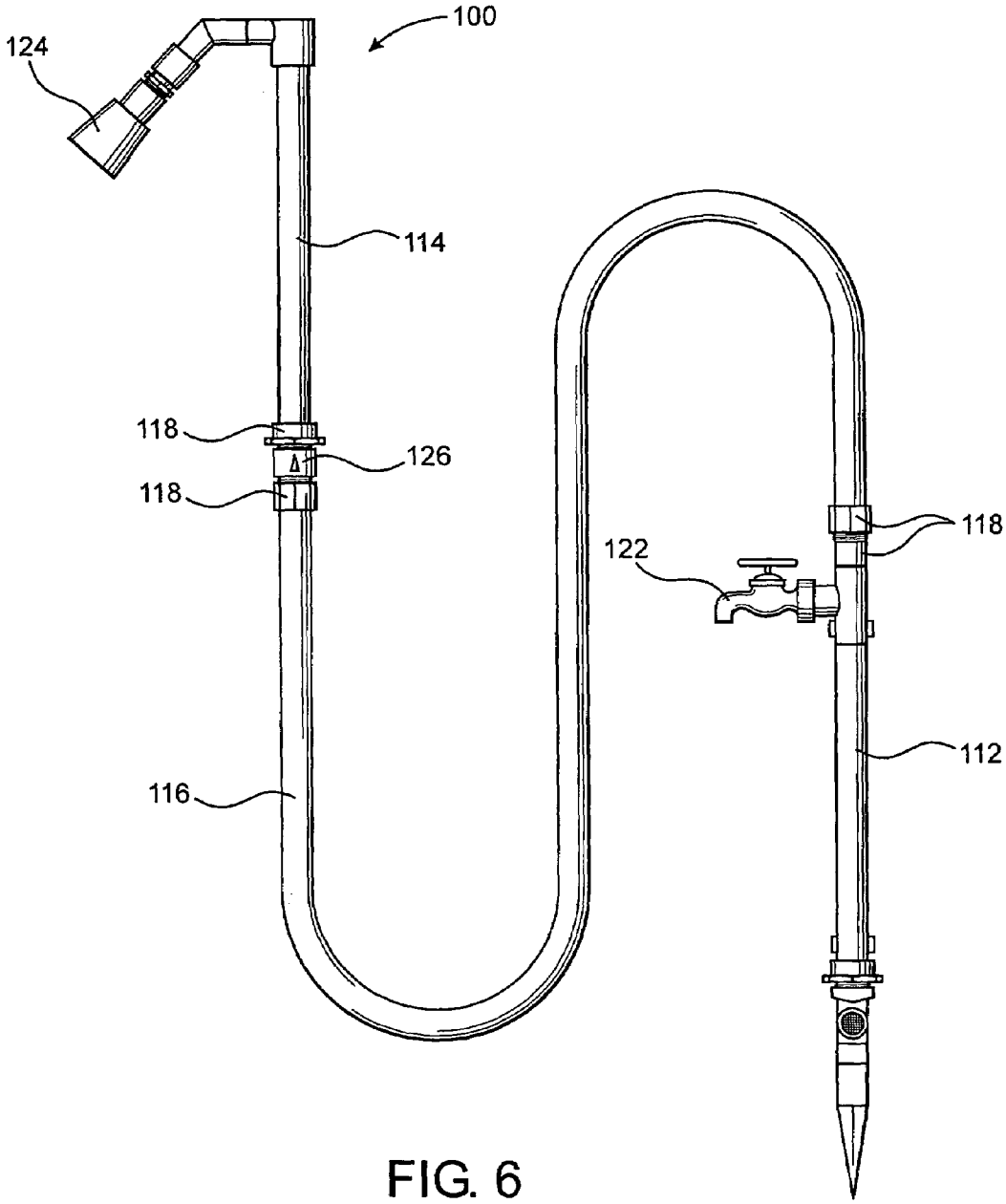
FIG. 6 is a side view of one preferred embodiment of a portable multi-point fluid delivery system illustrating an conduit extension.

The fluid conduit assembly 110 of the present invention further comprises a conduit extension 116 which is disposed in a fluid communicating relation with the stationary conduit 112 and the positionable conduit 114. As above, at least one releasable connector 118 is utilized to connect the conduit extension 116 in the fluid communicating relation with the stationary conduit 112 and the positionable conduit 114. More in particular, the conduit extension 116 is structured to permit the positionable conduit 114 to be disposed in a spaced apart relation from the stationary conduit 112, preferably, in any of a plurality of spaced apart locations. As illustrated in the preferred embodiment of FIG. 6, the conduit extension 116 is disposed in the fluid communicating relation between the stationary conduit 112 and the positionable conduit 114. As further illustrated in FIG. 6, the conduit extension 116 preferably comprises a flexible configuration so as to facilitate the disposition of the positionable conduit 114 into any of the plurality of spaced apart locations. In at least one embodiment, the conduit extension 116 comprises a standard garden hose having standard threaded male and female hose bib connectors 118, however, it is understood to be within the scope and intent of the present invention that any of a number of conduits may serve as a conduit extension 116.

In a preferred embodiment, the portable multi-point fluid delivery system 100 of the present invention further comprises a flow control assembly 120 structured to regulate the delivery of fluid through and by the system 100. The flow control assembly 120 includes at least one fixed fluid delivery member 122 disposed in fluid communication with at least a portion of the stationary conduit 112, and a positionable fluid delivery member 124 being disposed in fluid communication with the positionable conduit 114, preferably, at one end thereof. In at least one embodiment, the fixed fluid delivery member 122 comprises a spigot, as illustrated throughout the figures, having an integral valve structured to regulate fluid flow therethrough, and a downward extending spout to direct the fluid flow in a generally downward direction, when the stationary conduit is disposed in an operable orientation, as discussed in further detail below.

The flow control assembly 120 further comprises a positionable fluid delivery member 124, as noted above, the positionable fluid delivery member 124 in one preferred embodiment comprising an adjustable spray head to allow the user to adjust the delivery of a fluid through the spray head, for example, the radius of coverage and/or the spray droplet size. In order to permit the user to regulate the flow of fluid through the positionable fluid delivery member 124, the flow control assembly 120, in at least one embodiment, further comprises a flow control member 126. The flow control member 126 is preferably disposed in fluid communication between the stationary fluid delivery member 122 and the positionable fluid delivery member 124, as illustrated in the figures. The flow control member 126 may comprise any of the number of valves as are utilized to regulate fluid flow through a conduit. For example, the flow control member 126 may comprise a simple on/off type of valve or, alternatively, the flow control member 126 may comprise a precision flow regulating valve so as to provide the user with even greater flexibility in regulating the delivery of fluid to a plurality of spaced apart locations.

As will be appreciated from the foregoing, the flexible conduit extension 116 allows a user of the system 100 of the present invention to deliver fluid to any of the plurality of spaced apart location by virtue of the positionable fluid delivery member 124 being disposed in fluid communication with the positionable conduit 114. More specifically, the user may vary the location of the positionable conduit 114 relative to the stationary conduit 112 because the conduit extension 116 is disposed in fluid communication therebetween. It will further be appreciated that by virtue of the flow control assembly 120, in conjunction with the positionable conduit 114 disposed in fluid communicating relation with the conduit extension 116, the user can deliver fluid to a plurality of spaced apart locations, either independently or simultaneously.

The portable multi-point fluid delivery system 100 further comprises at least one fluid inlet member, as shown at 128, being structured to connect the system 100 to a fluid supply, such as a pressurized potable water supply. Similar to the releasable connectors 118, the fluid inlet member 128 may comprise a standard hose bib connection to facilitate connection of the system 10 to the fluid supply. In one preferred embodiment, the portable multi-point fluid delivery system 100 comprises a plurality of inlet members 128 to permit the system 100 to be connected to a plurality of fluid supplies, such as may be required in situations wherein a large volume of fluid is required to be delivered by the system 100.

A preferred embodiment of the portable multi-point fluid delivery system 100 of the present invention further comprises a base member 113. The base member 113 is attached to at least a portion of the fluid conduit assembly 110 and is structured to support at least the portion of the fluid conduit assembly 110 in an operable orientation. More in particular, in at least one embodiment, the base member 113 is attached to a portion of the stationary conduit 112, as illustrated in the figures, and is structured to maintain the stationary conduit 112 in a substantially upright and operable orientation. As such, it will be appreciated that in this embodiment, the stationary conduit 112 preferably comprises a substantially rigid material of construction such as, for example, schedule 40 PVC pipe In one further preferred embodiment, the base member 113 comprises a winged metal spike such as illustrated, by way of example, in FIG. 4. The winged metal spike configuration of the base member 113 is structured to facilitate penetration of a portion of a support medium, for example, a portion of the ground, such that the portable multi-point fluid delivery system 100 may be temporarily yet securely installed and readied for use without requiring specialized skill or utilizing specialized tools. Specifically, the winged metal spike configuration of the base member 113 allows a user to quickly and simply install the base member 113 into the support media by placing one foot on one side of the winged spike and placing their weight onto the winged metal spike thereby resulting in penetration of base member 113 into the support media, and temporary yet secure support of the stationary conduit 112 in the operable orientation. As will be appreciated, the base member 113 allows the portable multi-point fluid delivery system 100 to be quickly and easily installed for usage wherever and whenever needed.

Figure 4:
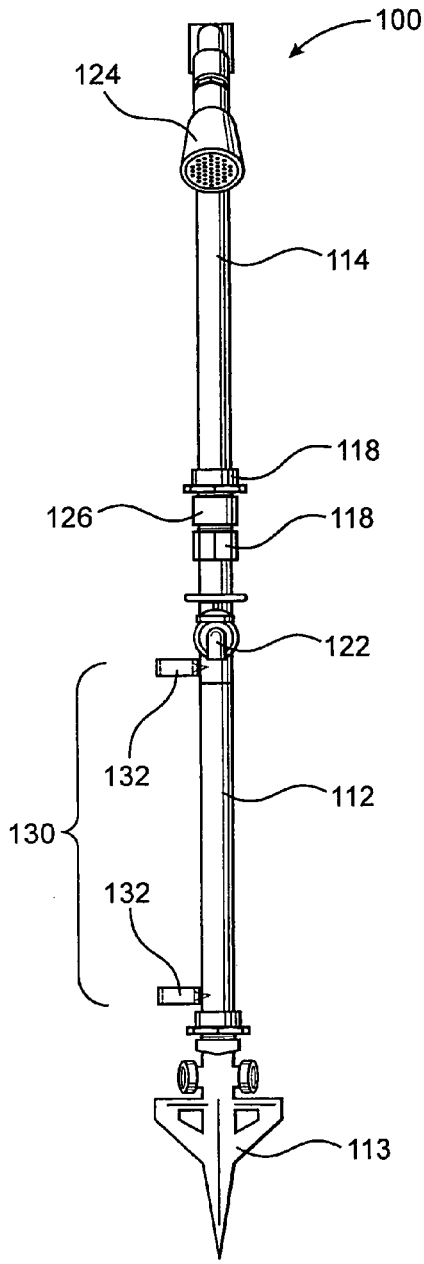
FIG. 4 shows an anterior view of the unit, emphasizing the shape of the ground stake.
Figure 5:
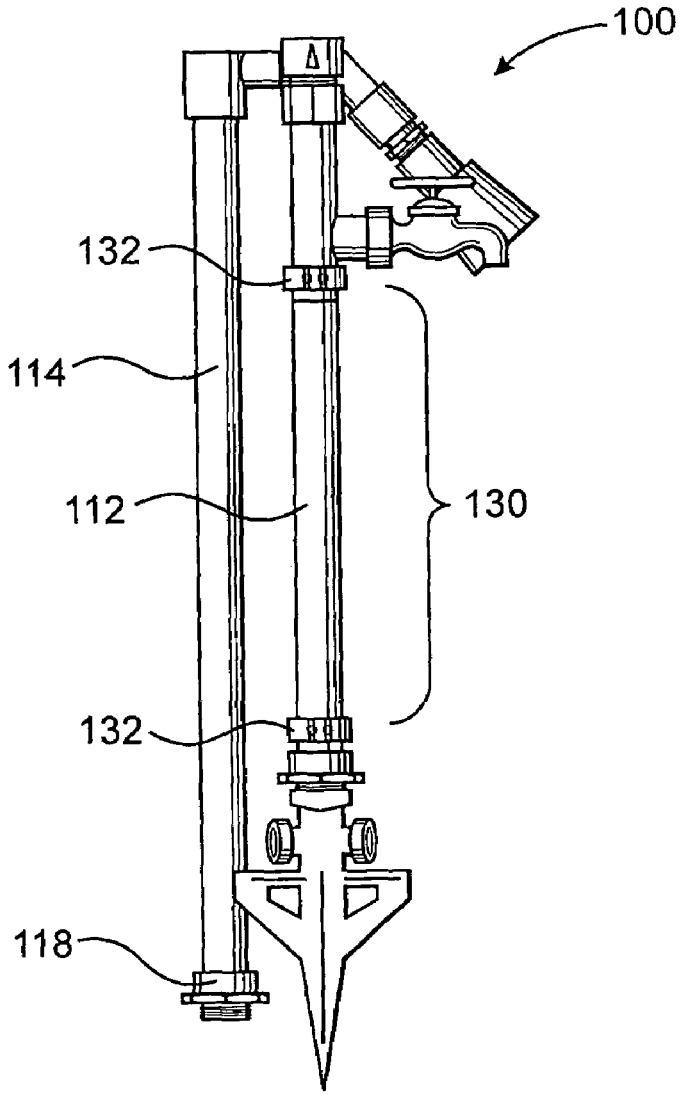
FIG. 5 shows the unit in its shipping and storage form.

At least one embodiment of the portable multi-point fluid delivery system 100 of the present invention further comprises a storage assembly 130. The storage assembly 130 comprises at least one storage member 132, the storage member 132 being attached to the fluid conduit assembly 110 and structured to retain at least one conduit, for example, the stationary conduit 112 or the positionable conduit 114. As illustrated in FIGS. 4 and 5, one preferred embodiment of the present invention comprises a storage assembly 130 having a plurality of storage members 132, the plurality of storage members 132 being attached to the stationary conduit 112. When the stationary conduit 112 and the positionable conduit 114 are disconnected from one another via the releasable connector 118, as illustrated in FIG. 5, it will be appreciated that the positionable conduit 114 may be readily positioned and retained within the plurality of storage members 132 of the storage assembly 130, thereby provided a compact storage profile to facilitate storage and transport of the portable multi-point fluid delivery system 100 of the present invention.

One embodiment of the portable multi-point fluid delivery system 100 of the present invention comprises the portable shower and faucet system illustrated in FIG. 1. At the base of the unit, the solid-metal garden hose spike 15 connects to a ½-inch by ¾-inch PVC reducing male adapter, male iron pipe thread by socket 2, using Teflon tape to ensure water tightness. At the open end of the fitting, connect a 25½-inch-long ¾-inch PVC pipe 14, using PVC cement. At open end of pipe, connect a ¾-inch by ½-inch PVC fitting reducing "T", socket by female iron pipe thread 11, using PVC cement to ensure seal, making sure to align the "T" section of 11 parallel with the intake section of the hose outlet of the garden hose spike 15.

At the open end of the ¾-inch by ½-inch PVC fitting reducing "T" 11, insert a 1½-inch-long ¾-inch PVC pipe 3 halfway into fitting 11, using PVC cement to ensure seal. Connect ½-inch standard brass hose bib spigot 12 to perpendicular opening of the ¾-inch by ½-inch PVC fitting reducing "T" 11, using Teflon tape to ensure water tightness around seal. At the inline opening of the 1½-inch-long ¾-inch PVC pipe 3, connect the ¾-inch PVC male adapter, male iron pipe thread by socket 7, using PVC cement to seal connection. Wrap the threads at open end of 1½-inch-long ¾-inch PVC pipe 3 with five strips of Teflon tape.

Attach the female end of the ¾-inch on-off brass hose valve 8, to open end of 1½-inch-long ¾-inch PVC pipe 3, using pliers to tighten firmly.

Using PVC cement, connect the 37½-inch-long ¾-inch PVC pipe 6 to the ¾-inch PVC female hose thread, swivel by socket 9.

At open threaded end of the %-inch on-off brass hose valve 8, connect the assembled unit consisting of the 37½-inch-long ¾-inch PVC pipe 6 and ¾-inch by ¾-inch PVC female hose thread, swivel by socket 9. At open end of the 37½-inch-long ¾-inch PVC pipe 6, connect, using PVC cement, the 90-degree ¾-inch PVC "street elbow", spigot end by socket 5. The swivel connector on the ¾-inch by ¾-inch PVC female hose thread, swivel by socket 9 prevents the need for proper alignment with remainder of unit.

At open end of the 90-degree ¼-inch PVC "street elbow," spigot end by socket 5, connect the 45-degree ¾-inch PVC elbow by socket 4—angled toward the ground—using PVC cement to ensure water tightness.

Insert 1½-inch-long ¾-inch PVC pipe 3 halfway into open end of 45-degree ¾-inch PVC elbow by socket 4, using PVC cement to ensure water tightness. Place a ½-inch by ¾-inch PVC reducing male adapter, male iron pipe thread by socket 2, over open end of 1½-inch-long ¾-inch PVC pipe 3, making sure to completely cover 1½-inch-long ¾-inch PVC pipe 3, and use PVC cement to ensure water tightness. Place five strips of Teflon tape over threads on ½-inch by ¾-inch PVC reducing male adapter, male iron pipe thread by socket 2. Connect the standard adjustable-spray showerhead 1 to the threaded end of ½-inch by ¾-inch PVC reducing male adapter, male iron pipe thread by socket 2, tightening by hand until firm.

Connect the convex side of the 1-inch PVC saddle clip 13 to the lower side of the ¾-inch by ½-inch PVC fitting reducing "T" 11, using two No. 4 by ⅜-inch Phillips oval sheet metal stainless steel screws 10, making sure to angle the 1-inch PVC saddle clip 13 90-degrees from the ¾-inch on-off brass hose valve 8 (FIG. 1).

Connect the convex side of the 1-inch PVC saddle clip 13 to the ½-inch by ¾-inch PVC reducing male adapter, male iron pipe thread by socket 2, using two No. 4 by ⅜-inch Phillips oval sheet metal stainless steel screws 10, making sure to angle the 1-inch PVC saddle clip 13 identically to the clip at the base of the ¾-inch by ½-inch PVC fitting reducing "T" 11 (FIG. 1).

The unit may be broken down into two pieces for storage. At open threaded end of the ¾-inch on-off brass hose valve 8, turn the swivel end of the ¾-inch by ¾-inch PVC female hose thread, swivel by socket 9 counterclockwise until the two pieces come apart.

Using the two 1-inch PVC saddle clips 13, snap the two halves together until they are firmly entrenched in the 1-inch PVC saddle clips 13.

Accordingly, it can be seen that the flexibility of the present system 100 far exceeds any previous item of like name or design. As a freestanding unit, the overall durability of this product stands unexcelled. As two separate units, this product can perform thousands of tasks with a simple twist of the wrist. Made of durable materials and expert construction, no mass-produced product carries the same quality this invention has. Because of all these and myriad other unstated reasons, the portable multi-point fluid delivery system 100 of present invention warrants a patent.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described

What is claimed is:

1. A portable multi-point fluid delivery system comprising:

a fluid conduit assembly having a stationary conduit and a positionable conduit disposed in a fluid communicating relation with one another, at least one fluid inlet member structured to facilitate connection of said system to a fluid supply, a flow control assembly comprising a fixed fluid delivery member disposed in fluid communication with said stationary conduit and a positionable fluid delivery member disposed in fluid communication with said positionable conduit, said flow control assembly structured to regulate fluid flow from said fixed fluid delivery member and said positionable fluid delivery member independent of one another, said flow control assembly further structured to regulate fluid flow from said fixed fluid delivery member and said positionable fluid delivery member simultaneous with one another, a flexible conduit extension disposed in said fluid communicating relation with said stationary conduit and said positionable conduit, a plurality of hose bib connectors structured to releasably interconnect said flexible conduit extension in said fluid communication between said stationary conduit and said positionable conduit, and to permit a user to assemble and disassemble said fluid conduit assembly, said flexible conduit extension structured to allow disposition of said positionable fluid delivery member in a spaced apart relation from said fixed fluid delivery member, thereby permitting fluid to be delivered to any of a plurality of spaced apart locations, said positionable fluid delivery member is removably interconnected to said positionable conduit via an elbow in downwardly angled disposition to facilitate delivery of fluid to any of said plurality of spaced apart locations, and a said storage assembly attached to said fluid conduit assembly and structured to facilitate storage and transport said fluid conduit assembly.

2. The system as recited in claim 1 wherein said storage assembly comprises at least one storage member attached to said conduit assembly, said storage member structured and disposed to releasably yet securely retain either of said fixed conduit or said positionable conduit.

3. The system as recited in claim 1 wherein said storage assembly comprises a plurality of storage members attached to said conduit assembly, said plurality of storage members structured and disposed to releasably yet securely retain either of said fixed conduit or said positionable conduit.

4. A portable multi-point fluid delivery system comprising:

a fluid conduit assembly having a stationary conduit and a positionable conduit disposed in a fluid communicating relationship with one another, a plurality of fluid inlet members each structured to facilitate connection of said system to a fluid supply, a flow control assembly comprising a spigot disposed in fluid communication with said stationary conduit and an adjustable spray head disposed in fluid communication with said positionable conduit, said flow control assembly further comprising a flow control member disposed in fluid communication between said fixed conduit and said positionable conduit, said flow control assembly structured to permit fluid flow from said spigot and said adjustable spray head independent of one another, said flow control assembly further structured to permit fluid flow from said spigot and said adjustable spray head simultaneous with one another, a flexible conduit extension interconnected in said fluid communicating relation with said stationary conduit and said positionable conduit, said flexible conduit extension structured to allow disposition of said positionable fluid delivery member in a spaced apart relation from said fixed fluid delivery member, thereby permitting fluid to be delivered to any of a plurality of spaced apart locations, and a plurality of storage members attached to said stationary conduit structured to retain said positionable conduit when said stationary conduit and said stationary conduit are disconnected from one another and to create a compact storage profile to facilitate storage and transport said fluid conduit assembly.

5. A portable multi-point fluid delivery system comprising:

a fluid conduit assembly having a stationary conduit and a positionable conduit disposed in a fluid communicating relationship with one another, a plurality of fluid inlet members each structured to facilitate connection of said system to a fluid supply, a flow control assembly comprising a spigot disposed in fluid communication with said stationary conduit and an adjustable spray head disposed in fluid communication with said positionable conduit, said flow control assembly further comprising a flow control member disposed in fluid communication between said fixed conduit and said positionable conduit, said flow control assembly structured to permit fluid flow from said spigot and said adjustable spray head independent of one another, said flow control assembly further structured to permit fluid flow from said spigot and said adjustable spray head simultaneous with one another, a hose interconnected in said fluid communicating relation between said stationary conduit and said positionable conduit, a plurality of hose bib connectors structured to releasably interconnect said hose in said fluid communication between said stationary conduit and said positionable conduit, and to permit a user to assemble and disassemble said fluid conduit assembly, said hose structured to allow disposition of said positionable fluid delivery member in a spaced apart relation from said fixed fluid delivery member, thereby permitting fluid to be delivered to any of a plurality of spaced apart locations, said positionable fluid delivery member is removably interconnected to said positionable conduit via an elbow in downwardly angled disposition to facilitate delivery of fluid to any of said plurality of spaced apart locations, and a plurality of storage members attached to said stationary conduit and structured to retain said positionable conduit, when said stationary conduit and said stationary conduit are disconnected from one another, and create a compact storage profile to facilitate storage and transport.

* * * * *